US006427598B1

(12) United States Patent
Boss

(10) Patent No.: US 6,427,598 B1
(45) Date of Patent: Aug. 6, 2002

(54) METHOD AND DEVICE FOR CORRECTING THE PREDETERMINED DISAGGREGATION TIME OF A SPIN-STABILIZED PROGRAMMABLE PROJECTILE

(75) Inventor: André Boss, Zurich (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 09/413,289

(22) Filed: Oct. 6, 1999

(30) Foreign Application Priority Data

Oct. 8, 1998 (CH) ..... 2034/98

(51) Int. Cl.[7] ..... F42C 11/06

(52) U.S. Cl. ..... 102/264; 102/266; 89/8.65; 235/408

(58) Field of Search ..... 102/262, 264, 102/265, 266, 270, 271; 89/6, 6.5; 235/408

(56) References Cited

U.S. PATENT DOCUMENTS

| | | | | |
|---|---|---|---|---|
| 4,686,885 A | | 8/1987 | Bai | 89/6.5 |
| 5,497,704 A | * | 3/1996 | Kurschner et al. | 102/264 |
| 5,787,785 A | * | 8/1998 | Muenzel et al. | 102/266 |
| 5,814,755 A | * | 9/1998 | Boss | 89/6.5 |
| 5,814,756 A | * | 9/1998 | Boss | 89/6.5 |
| 5,834,675 A | * | 11/1998 | Boss | 89/6.5 |
| 6,129,024 A | * | 10/2000 | Gerber et al. | 102/521 |

FOREIGN PATENT DOCUMENTS

| | | |
|---|---|---|
| DE | 33 09 147 | 9/1984 |
| EP | 0 661 516 A1 | 7/1995 |
| EP | 0 802 390 A1 | 9/1998 |
| EP | 0 802 392 | 9/1998 |
| EP | 0 802 391 A1 | 11/1998 |

OTHER PUBLICATIONS

OC 2052 d 94, Oerlikon Contraves company of Zurich, Switzerland *Firing Range Allensteig*, Sep., 1993.

* cited by examiner

*Primary Examiner*—Harold J. Tudor
(74) *Attorney, Agent, or Firm*—Townsend and Townsend and Crew LLP; Guy W. Chambers

(57) ABSTRACT

The determination of the active projectile velocity required for the correction computation and the correction of the disaggregation time ($Tz(v_o)$) are performed in a projectile after it has been fired. The velocity measurement takes place in the form of a measurement of a first time (t) which is required for a defined number of revolutions (Nm) of the projectile, wherein a velocity difference, which must be multiplied by a correction factor, is expressed by the actual projectile velocity and a lead velocity of the projectile by means of a time difference (t–tm) formed from the first time (t) and a predetermined second time (tm).

3 Claims, 3 Drawing Sheets

METHOD AND DEVICE FOR CORRECTING THE PREDETERMINED DISAGGREGATION TIME OF A SPIN-STABILIZED PROGRAMMABLE PROJECTILE

FIELD OF THE INVENTION

The invention relates to a method for calculating and correcting the disaggregation time of a spin-stabilized programmable projectile, wherein a correction factor, which has been multiplied by a velocity difference, is added to the disaggregation time, and wherein the velocity difference is formed from an actually measured projectile velocity and from a lead velocity of the projectile. The invention further relates to a device for executing the method.

BACKGROUND OF THE INVENTION

Such projectiles, which have become known from a publication OC 2052 d 94 of the Oerlikon Contraves company of Zürich, Switzerland, have sub-projectiles, which can destroy an attacking target by multiple impacts if, following the ejection of the sub-projectiles at the disaggregation time, the expected area of the target is constituted by a cloud formed by the sub-projectiles. However, in this case it is not always possible to achieve a satisfactory impact, or respectively shoot-down probability, because of variations in a predetermined optimal disaggregation distance which, for example, are caused by variations in the projectile velocity.

A method for calculating the disaggregation time of a programmable projectile of the above described type, by means of which the impact, or respectively shoot-down probability, can be improved, has become known in U.S. Pat. Nos. 5,814,755; 5,814,756 and 5,834,675. In this case, the calculation is at a minimum based on an impact distance to a target object, a projectile velocity measured at the muzzle of a gun barrel, and a predetermined optimal disaggregation distance between an impact point of the target and a disaggregation point of the projectile. The optimal disaggregation distance provided is kept constant by means of correcting the disaggregation time of the projectile. Correction is performed in that a correcting factor, which is multiplied by a velocity difference, is added to the disaggregation time. The projectile velocity difference is formed from the difference between the actually measured projectile velocity and a lead velocity of the projectile, wherein the lead velocity is calculated from the average value of a number of previous successive projectile velocities. The corrected disaggregation time is transmitted inductively to the projectile at the time of firing in order to set a time fuse of the projectile.

With this method, the actual projectile velocity is determined by means of a measuring device arranged at the muzzle of the gun tube. The measuring device consists of two annular coils arranged at a defined distance from each other. In the course of the passage of the projectile through the two annular coils, a pulse is generated in each annular coil in a rapid sequence because of the change in the magnetic flux caused by this passage. The pulses are provided to an electronic evaluation device, in which the projectile velocity is calculated from the chronological distance between the pulses and the distance between the annular coils.

In connection with guns which, because of their design. (Gatling guns, guns firing large projectiles), do not permit the present arrangement, it is advantageous to process and transmit the information transmission and the measurement results at point different from the muzzle.

OBJECT AND SUMMARY OF THE INVENTION

The determination of the projectile velocity and the correction of the disaggregation time is performed in the projectile after it has been fired. The velocity measurement takes place in the form of a measurement of an initial time needed for a defined number of revolutions of the projectile, wherein the velocity difference, which must be multiplied by a correction factor, is expressed by a time difference formed by the initial time and a predetermined second time.

The advantages obtained by means of the invention lie in particular in that errors, which can occur when utilizing measurement devices arranged at the muzzles of the guns, are eliminated, and that the projectiles can also be used for guns which do not have such measuring devices.

The invention will be explained in greater detail in what follows by means of several exemplary embodiments and in connection with the drawings.

DETAILED DESCRIPTION OF THE PREFERRED EMBODIMENTS

Figure 1:
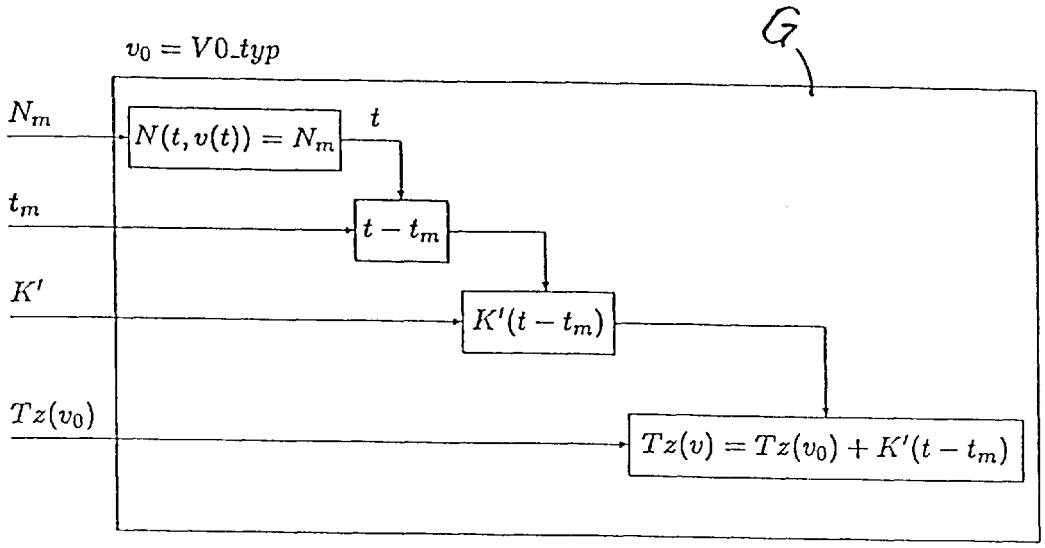
FIG. 1 represents a block circuit diagram of the calculating method in accordance with the invention in a first embodiment.

In FIG. 1, G identifies a projectile, to which, prior to it being fired, the following are transmitted; a defined number of revolutions $N_m$, a predetermined second time $t_m$, a disaggregation time $Tz(v_0)$ and a second correction factor K', which is calculated while taking into consideration a first correction factor K, known from the prior art, as described in greater detail below. In this case, the transmitted disaggregation time $Tz(v_0)$ is a function of a value $v_0$=VO_typ, wherein VO_typ refers to a typical or standard projectile velocity as it leaves the muzzle. The typical muzzle velocity, VO_typ, is used in a lead calculator or in a device between the lead calculator and the transmission.

Figure 5:
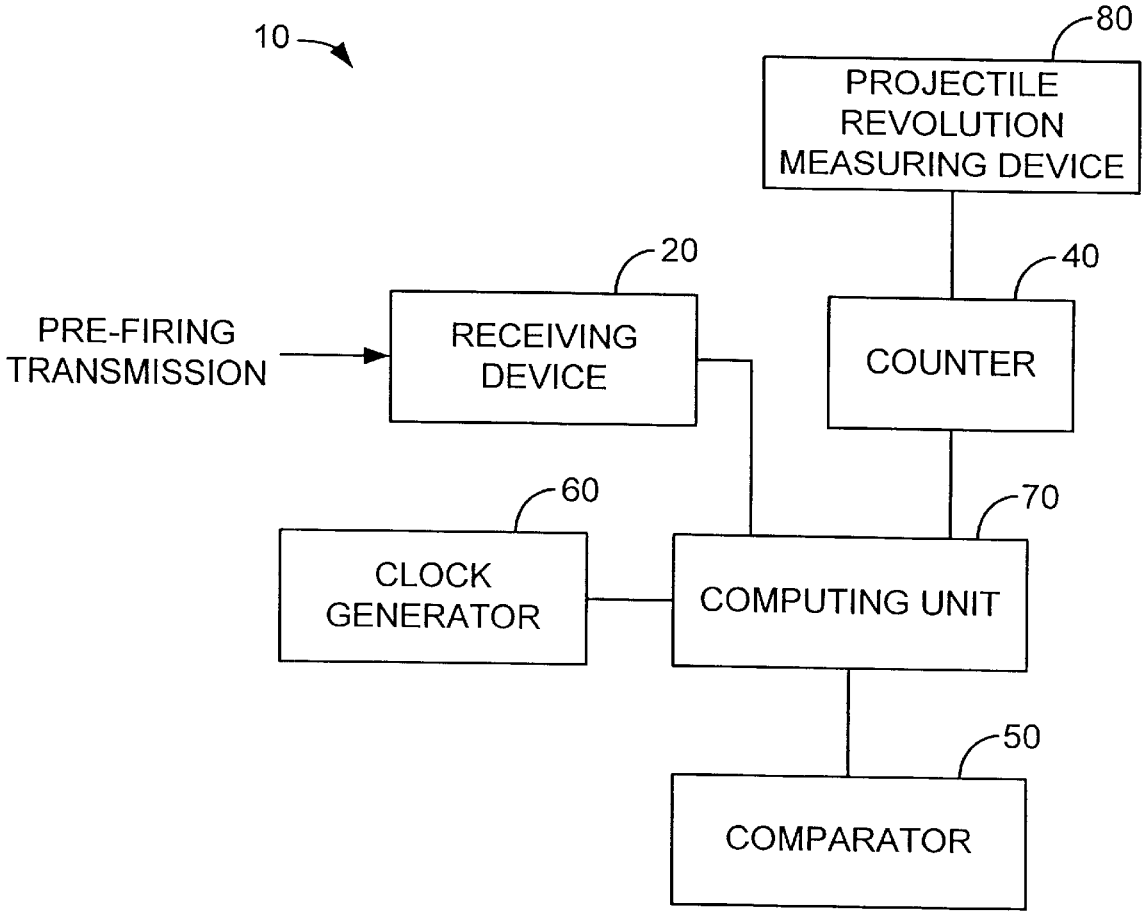
FIG. 5 illustrates a preferred form of electronic projectile device for calculating the corrected disaggregation time of the present invention.

For receiving and processing transmitted information, the projectile has a device 10, as shown in FIG. 5, which consists at least of a receiving device 20 for receiving the transmitted information with predetermined values, a projectile revolution measurement device 30 (for example magnetically, etc.) of the revolutions of the projectile, a counter 40 for counting the revolutions of the projectile, a comparator 50, a clock generator 60 and a computing unit 70 adapted to execute subtraction, addition and multiplication.

At the time of firing the projectile, the counter and the clock generator are started wherein, in case of an agreement of the counter setting and of the defined number of revolutions $N_m$, a first time t, required for the count, is defined by the clock signal of the clock generator. Thereafter, a time difference $t-t_m$ is formed from the first time t and the second time $t_m$, which is multiplied by the second correction factor K'. Then, the disaggregation time $Tz(v_o)$ is added to the time difference $t-t_m$ multiplied by the second correction factor K', and the corrected disaggregation time Tz(v) is obtained in this way in accordance with the Equation (5) derived in what follows.

Figure 2:
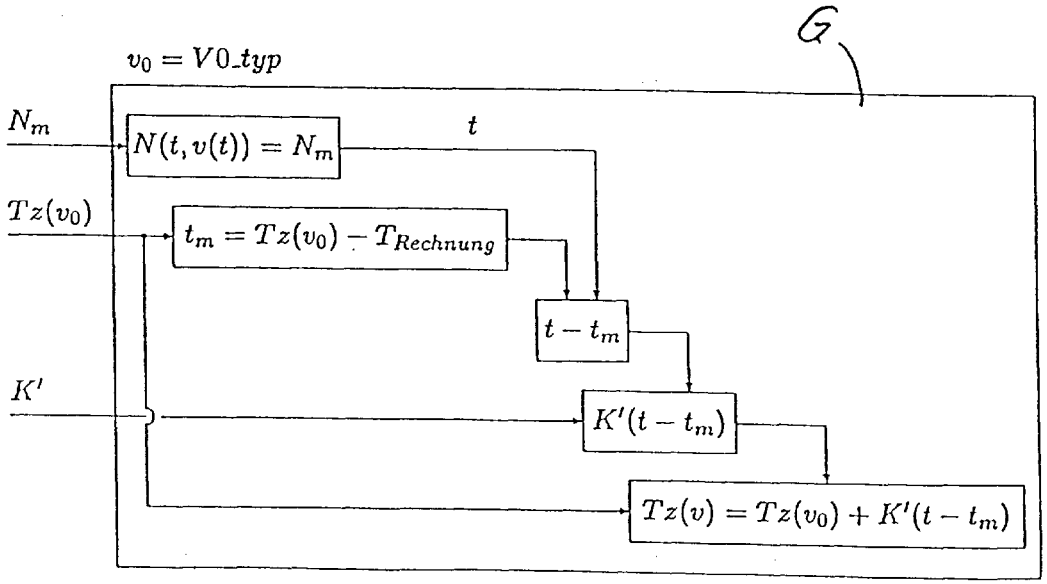
FIG. 2 represents a block circuit diagram of a variation of the calculating method in FIG. 1, FIG. 3 a block circuit diagram of the calculating method in a second form of execution.

In accordance with FIG. 2, the predetermined second time $t_m$ is calculated in the projectile in accordance with the equation $t_m=Tz(v_o)-T_{rech}$, wherein $T_{rech}$ is a calculation time for the operations in the projectile and pre-programmed in the projectile, which will be explained in what follows.

Figure 3:
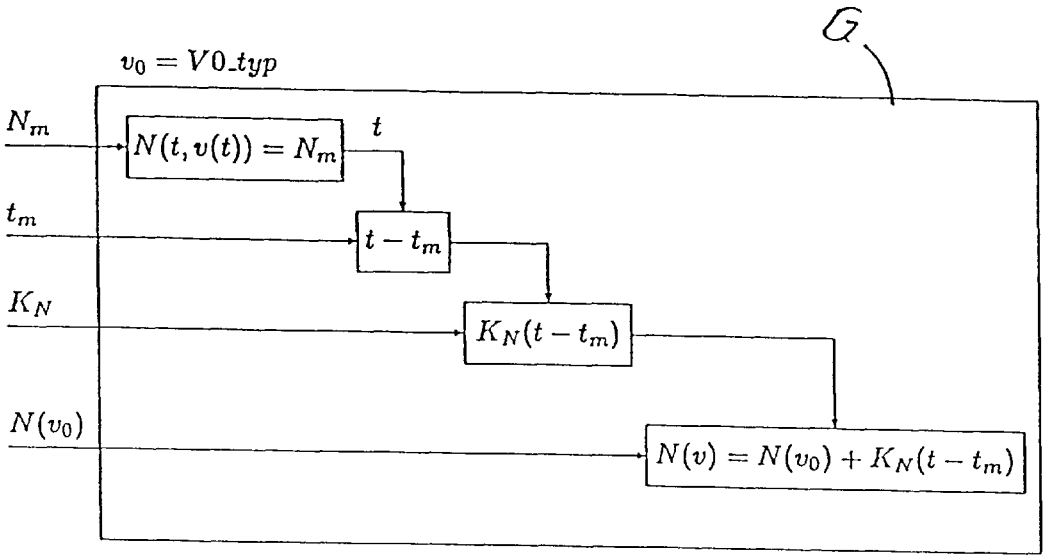

In accordance with FIG. 3, instead of the disaggregation time $Tz(v_o)$, a number of revolutions $N(v_o)$, which the projectile would perform at the initial velocity $v_o$ during this time, is used, and in place of the second correction factor K' a third correction factor $K_N$ is used, which is calculated while taking into consideration the first correction factor K from the mentioned prior art, wherein a corrected effective number of revolutions N(v) in accordance with the Equation (4) derived in what follows, is obtained as the final result.

Figure 4:
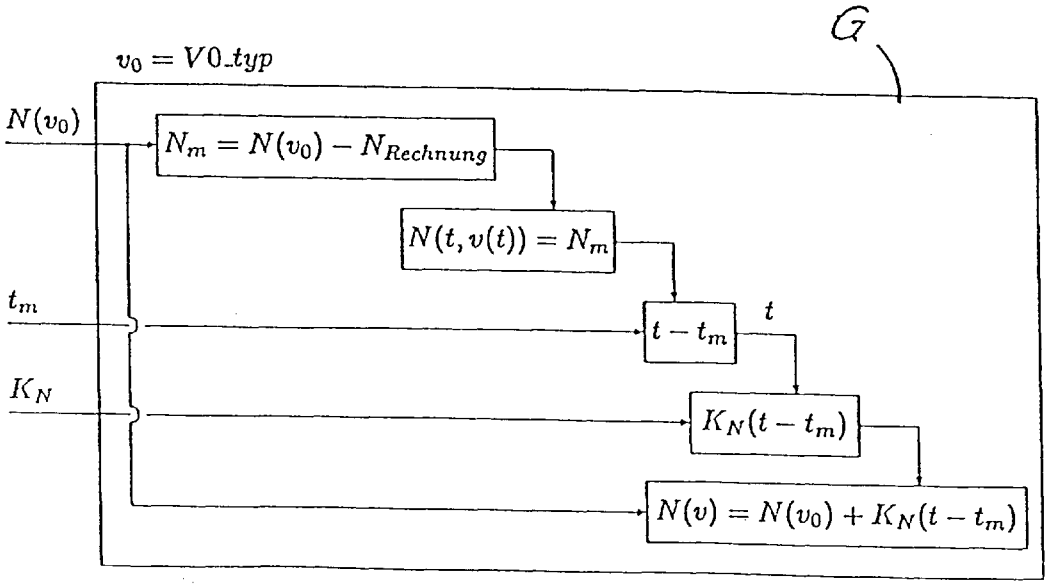
FIG. 4 represents a block circuit diagram of a variation of the calculating method in FIG. 3.

In accordance with FIG. 4, the defined number of revolutions $N_m$ of the projectile is calculated in accordance with an equation $N_m=N(v_o)-N_{rech}$, wherein $N_{rech}$ is a constant value pre-programmed in the projectile, which will be explained in greater detail in what follows.

The second time $t_m$ should only be insignificantly less than the disaggregation time $T_z$ in order to maximize the accuracy of the measurements of the effective number of revolutions. On the other hand, the time period $Tz-t_m$ must be sufficiently large for performing the correction calculations during the calculating time $T_{rech}$. In this case a possible variation in the meteorological data in respect to the effective initial velocity $v_o$ within a defined tolerance range of the standard meteorological data in respect to $v_o$ must be taken into consideration. In particular, a sufficient amount of calculating time in respect to a defined maximum velocity of the projectile should be available. Moreover, the selection of $T_{rech}$ also depends on the area of employment of the gun, as well as on external factors, for example interferences.

The value $N_{rech}=N_{rech}(T_{rech})$ is that constant number of revolutions which the projectile can perform at most during the flying time between $t_m$ and $t_m+T_{rech}$. The value $N_{rech}$ is fixed and for example is 700 revolutions, which corresponds to a calculating time $T_{rech}$ of approximately ¾ seconds ($T_{rech}$ and $N_{rech}$ are characteristic values—known in the projectile of FIGS. 2 and 4—and in the device).

The calculation of the correction factors $K_N$ and K' is based on a law in the form of a table, a function or an approximation for the reduction in the number of revolutions of the projectile, wherein it is assumed that the law is expressed by a function $$f=f(t,v_o,\text{Meteo, Elevation})$$

in which influences such as pressure, temperature and wind are combined under meteo. The value elevation indicates the angle of elevation of a gun barrel, t is the flying time and $v_o$ the initial velocity of the projectile. For simplification of the expressions, in what follows the dependency on meteo and elevation is omitted, so that $f=f(t,v_o)$. The number of revolutions $N=N(t,v_o)$ of the projectile with the initial velocity $v_o$ in the time interval from 0 to t then is:

$$N(t,v_0)=\int_0^t f(\tau,v_0))d\tau. \tag{1}$$

With the disaggregation time $Tz=Tz(v_o)$ calculated from the lead calculation for the ballistics of the projectile, the corrected disaggregation time known from the mentioned prior art results $$Tz(v)=Tz(v_0)+K(v-v_0). \tag{2}$$

By means of a time $t_m<Tz$ inserted into the Equation (1) for t, the number of revolutions, which the projectile with the initial velocity $v_o$ performs until the time $t_m$, is defined as $$N_m:=N(t_m,v_0)$$

In this equation, ":=" is used to signify the definition of a term, rather than the calculation of a term.

In accordance with a function for the initial velocity of the projectile v=v(t). derived from the principle regarding implicit functions, the result for times t in the vicinity of $t_m$ is $$N(t,v(t))=N_m,$$

wherein it is possible to write into the Equation (1) of the first order $$v-v_0=-\frac{D_1N(t_m,v_0)}{D_2N(t_m,v_0)}(t-t_m)=-\frac{f(t_m,v_0)}{D_2N(t_m,v_0)}(t-t_m). \tag{3}$$

for the velocity difference $(v-v_o)$. it can be seen from Equation (3) that it is possible by measuring the time t, which is required until the projectile has performed the number of revolutions $N_m$, to make conclusions regarding the effective initial velocity v.

In connection with Equation (2), the following applies in the first order:

$$\begin{aligned}N(Tz(v),v)&=N(Tz(v_0),v_0)+\\&\quad(D_1N(Tz(v_0),v_0)K+D_2N(Tz(v_0),v_0))(v-v_0)\\&=N(Tz(v_0),v_0)+\\&\quad(f(Tz(v_0),v_0)K+D_2N(Tz(v_0),v_0))(v-v_0).\end{aligned}$$

With the aid of Equation (3), a conclusion $$\begin{aligned}N(Tz(v),v)&=N(Tz(v_0),v_0)+\\&\quad(f(Tz(v_0),v_0)K+D_2N(Tz(v_0),v_0))\cdot\\&\quad\left(-\frac{f(t_m,v_0)}{D_2N(t_m,v_0)}\right)(t-t_m).\end{aligned}$$

is made, so that the third correction factor $K_N$ is defined as $$K_N:=(f(Tz(v_0),v_0)K+D_2N(Tz(v_0),v_0))\left(-\frac{f(t_m,v_0)}{D_2N(t_m,v_0)}\right).$$

and the result for the number of revolutions until the corrected disaggregation time Tz(v) is $$N(Tz(v),v)=N(Tz(v_0),v_0)+K_N(t-t_m). \tag{4}$$

Departing from Equations (2) and (3), the following applies in the first order:

$$Tz(v)=Tz(v_0)+K\left(-\frac{f(t_m,v_0)}{D_2N(t_m,v_0)}\right)(t-t_m).$$

so that the second correction factor K' is defined as $$K' := K\left(-\frac{f(t_m, v_0)}{D_2N(t_m, v_0)}\right),$$

and the result for the corrected disaggregation time Tz(v) is $$Tz(v)=Tz(v_0)+K'(t-t_m). \quad (5)$$

The value $D_2N(t_m, v_o)$ results from the $v_o$ variation in Equation (1) and from the function $$f=f(t, v_o, \text{Meteo}, \text{Elevation})$$

already mentioned on page 5.

What is claimed is:

1. A method for calculating a corrected disaggregation time (Tz(v)) within a spin-stabilized programmable projectile comprising the steps of:

receiving in said projectile, prior to firing, a predetermined number of revolutions ($N_m$) a predetermined time ($t_m$), a predetermined disaggregation time ($Tz(v_0)$) and a predetermined correction factor (K');

ascertaining within said projectile the amount of time (t) required after the projectile is fired for the actual number of projectile revolutions (N(t, v(t))) to equal said predetermined number of revolutions ($N_m$);

calculating a time difference ($t-t_m$) by subtracting said predetermined time ($t_m$) from said ascertained time (t);

multiplying said time difference ($t-t_m$) by said predetermined correction factor (K'); and, calculating said corrected disaggregation time (Tz(v)) in said projectile by adding said predetermined disaggregation time ($Tz(v_0)$) to the result of multiplying said time difference ($t-t_m$) by said predetermined correction factor (K').

2. The method in accordance with claim 1 wherein, at the time the projectile is fired, a counter for counting the actual number of projectile revolutions (N(t, v(t))) and a clock are started so that when the counter setting and said predetermined number of revolutions ($N_m$) are equal, said ascertained time (t) corresponds to the amount of time elapsed on said clock.

3. A device within a spin-stabilized programmable projectile for calculating a corrected disaggregation time (Tz(v)) comprising:

a projectile receiving device for receiving, prior to firing, a predetermined number of revolutions ($N_m$), a predetermined time ($t_m$), a predetermined disaggregation time ($Tz(v_0)$) and a predetermined correction factor (K');

a projectile measuring device for measuring actual projectile revolutions;

a counter for counting the number of actual projectile revolutions measured by said projectile measuring device;

a comparator for comparing the number of projectile revolutions counted by said counter with said predetermined number of revolutions ($N_m$);

a clock generator for calculating the time elapsed after the projectile is fired; and, a computing unit for calculating a corrected disaggregation time (Tz(v)) by ascertaining the amount of time (t) required after the projectile is fired for the actual number of projectile revolutions (N(t, v(t))) to equal the predetermined number of revolutions ($N_m$), calculating a time difference ($t-t_m$) by subtracting said predetermined time ($t_m$) from said ascertained time (t), multiplying said time difference ($t-t_m$) by said predetermined correction factor (K'), and then adding that multiplication result to said predetermined disaggregation time ($Tz(v_0)$).

* * * * *